US005123765A

United States Patent [19]

O'Connell et al.

[11] Patent Number: 5,123,765

[45] Date of Patent: Jun. 23, 1992

[54] DISPOSABLE TOOTHBRUSH

[76] Inventors: Daniel J. O'Connell, 549 E. 234 St., Bronx, N.Y. 10470; George Spector, 233 Broadway, RM 3815, New York, N.Y. 10007

[21] Appl. No.: 677,985

[22] Filed: Apr. 1, 1991

[51] Int. Cl.[5] ..... A46B 11/02

[52] U.S. Cl. ..... 401/126; 401/125; 401/169; 401/183; 401/268

[58] Field of Search ..... 401/126, 123, 125, 164, 401/169, 183, 129, 268

[56] References Cited

U.S. PATENT DOCUMENTS

| | | | |
|---|---|---|---|
| 3,353,898 | 11/1967 | Lamberti | 401/126 X |
| 4,002,181 | 1/1977 | Rivera | 401/126 X |
| 5,028,158 | 7/1991 | Fey | 401/183 |

FOREIGN PATENT DOCUMENTS

| | | | |
|---|---|---|---|
| 527064 | 7/1956 | Canada | 401/125 |
| 163189 | 12/1985 | European Pat. Off. | 401/123 |
| 970819 | 1/1951 | France | 401/125 |
| 1161639 | 3/1958 | France | 401/169 |
| 1232728 | 10/1960 | France | 401/126 |
| 443561 | 3/1936 | United Kingdom | 401/169 |

*Primary Examiner*—Steven A. Bratlie

[57] ABSTRACT

A disposable toothbrush is provided and consists of an elongated tubular handle having a threaded aperture in a first end and a compartment therein and a brush member having a shaft with a head and bristles on a first end and threads on a second end. In one instance the brush member can be inserted into the compartment of the handle with the threaded second end engagable with the threaded aperture in the first end of the handle in a storage position. In another instance the brush member can be removed from the compartment of the handle and reversed with the threaded second end engagable with the threaded aperture in the first end of the handle in a useable position.

3 Claims, 1 Drawing Sheet

DISPOSABLE TOOTHBRUSH

BACKGROUND OF THE INVENTION

The instant invention relates generally to toothbrushes and more specifically it relates to a disposable toothbrush which provides an elongated handle threadable onto the brush member.

There are available various conventional toothbrushes which do not provide the novel improvements of the invention herein disclosed.

SUMMARY OF THE INVENTION

A primary object of the present invention is to provide a disposable toothbrush that will overcome the shortcomings of the prior art devices.

Another object is to provide a disposable toothbrush in which a brush member can in one instance be inserted into and threaded onto an elongated tubular handle in a storage position and in another instance be reversed and rethreaded onto the elongated tubular handle in a useable position.

An additional object is to provide a disposable toothbrush that includes a toothpaste fluidly connectable within the brush member so that the toothpaste can be discharged into the bristles of the brush member.

A further object is to provide a disposable toothbrush that is simple and easy to use.

A still further object is to provide a disposable toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
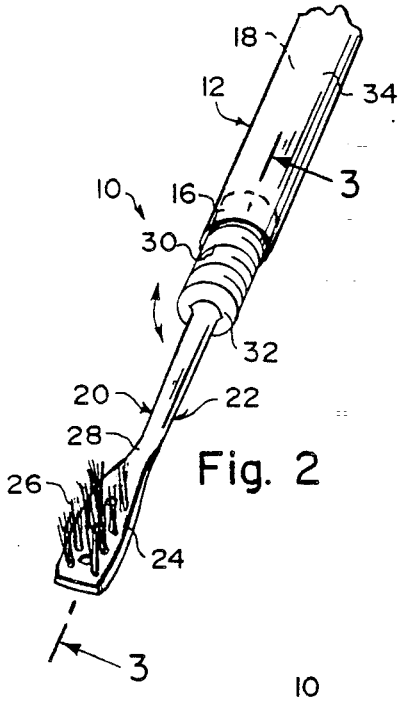
FIG. 2 is a perspective view of the instant invention in an opened ready to be used position.
Figure 1:
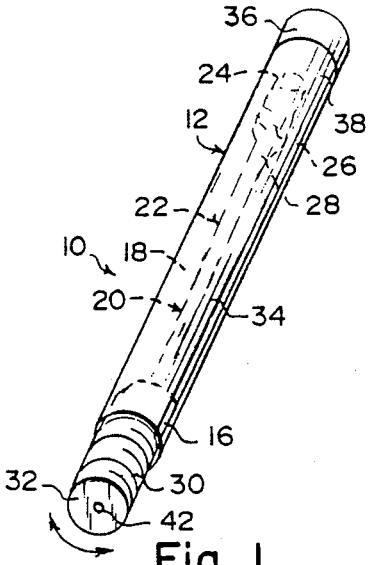
FIG. 1 is a perspective view of the instant invention in a closed stored position.
Figure 3:
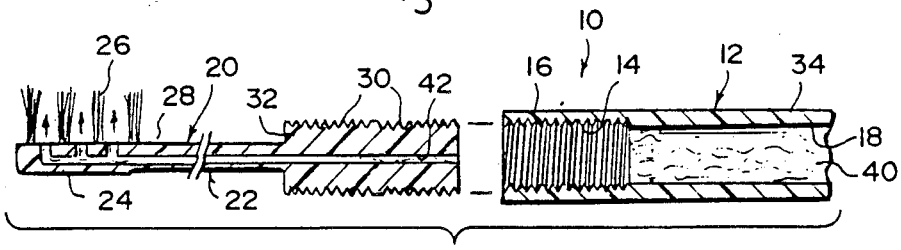
FIG. 3 is an enlarged cross sectional view taken along line 3—3 in FIG. 2 with the brush member detached from the elongated tubular handle having toothpaste therein.

Turning now descriptively to the drawings, in which similar reference characters denote similar elements throughout the several views, FIGS. 1 through 3 illustrate a disposable toothbrush 10 in which an elongated tubular handle 12 having a threaded aperture 14 in a first end 16 and a compartment 18 therein. A brush member 20 is provided having a shaft 22 with a head 24 and bristles 26 on a first end 28 and threads 30 on a second end 32. In one instance the brush member 20 can be inserted into the compartment 18 of the handle 12 with the threaded second end 32 engagable with the threaded aperture 14 in the first end of the handle 12 in a storage position. In another instance the brush member 20 can be removed from the compartment 18 of the handle 12 and reversed with the threaded second end 32 engagable with the threaded aperture 14 in the first end 16 of the handle 12 in a useable position.

The handle 12 has a flexible wall 34, while a cap member 36 is attachable to a second end 38 of the handle 12. When the cap member 36 is detached from the second end 38 of the handle 12, toothpaste 40 can be inserted within the compartment 18. The brush member 20 has a duct 42 therethrough, so that the flexible wall 34 can be depressed, the toothpaste 40 will enter the duct 42 and exit therefrom onto the bristles 26 on the brush member 20.

Figure 4:
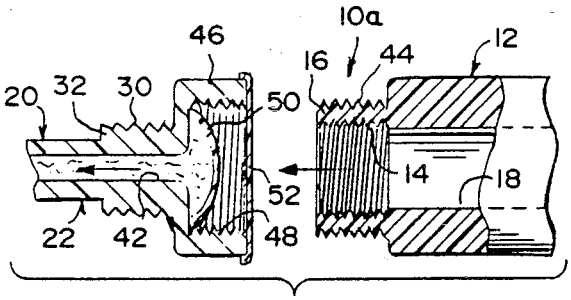
FIG. 4 is an enlarged cross sectional view similar to FIG. 3, but of a modification in which the toothpaste stored in the brush member is dispensed when the snap cap is removed and the diaphragm is compressed when attached to the handle in the used position.
Figure 5:
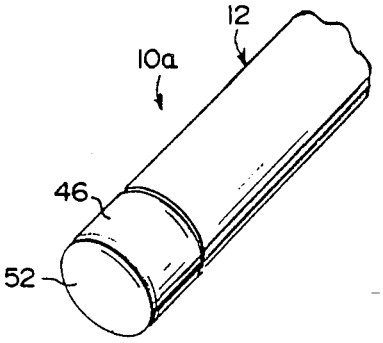
FIG. 5 is a perspective view of the modification in a stored position.

A modified disposable toothbrush **10*a* is shown in FIGS. 4 and 5 and includes the handle 12 having external threads 44 on the first end 16 thereof. A cup member 46 having internal threads 48 formed on the second end 32 of the brush member 20. The brush member 20 has the duct 42 therethrough extending into the cup member 46. Toothpaste 40 is carried within the duct 42 while a convex diaphragm 50 is inserted within the cup member 46. When the brush member 20 is placed in the useable position with the internal threads 48 of the cup member 46 engagable with the external threads 44 on the first end 16 of the handle 12, the diaphragm 50 will be compressed and the toothpaste 40 will enter the duct 42 to exit therefrom into the bristles 26 on the brush member 20**.

The modified disposable toothbrush **16*a* further includes a snap lid 52 to fit over the cup member 46 to prevent the accidental compression of the diaphragm 50 when the brush member 20** is placed in the stored position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable toothbrush which comprises:

a) an elongated tubular handle having a threaded aperture in a first end and a compartment therein;

b) a brush member having a shaft with a head and bristles on a first end and threads on a second end, so that in one instance said brush member can be inserted into the compartment of said handle with the threaded second end engagable with the threaded aperture in the first end of said handle in a storage position and in another instance said brush member can be removed from the compartment of said handle and reversed with the threaded second end engagable with the threaded aperture in the first end of said handle in a useable position;

c) said handle having external threads on the first end thereof; surrounding said threaded aperture;

d) a cup member having internal threads and formed on the second end of said brush member; adjacent the first said threads and adapted to receive said external threads;

e) said brush member having a duct therethrough extending into said cup member;

f) toothpaste carried within said duct; and g) a convex diaphragm inserted within said cup member, so that when said brush member is placed in the useable position with said internal threads of said cup member engageable with said external threads on the first end of said handle, said diaphragm will be compressed and said toothpaste will enter the duct to exit therefrom into the bristles on said brush member.

2. A disposable toothbrush as recited in claim 1, further including a snap lid to fit over said cup member to prevent the accidental compression of said diaphragm when said brush member is placed in the stored position.

3. A disposable toothbrush which comprises:

a) an elongated tubular handle having a threaded aperture in a first end and a compartment therein;

b) a brush member having a shaft with a head and bristles on a first end and threads on a second end, so that in one instance said brush member can be inserted into the compartment of said handle with the threaded second end engagable with the threaded aperture in the first end of said handle in a storage position and in another instance said brush member can be removed from the compartment of said handle and reversed with the threaded second end engagable with the threaded aperture in the first end of said handle in a useable position;

c) said handle having a flexible wall;

d) a cap member attachable to a second end of said handle so that when said cap member is detached from the second end of said handle toothpaste can be inserted within the compartment; and e) said brush member having a duct therethrough, so that said flexible wall can be depressed, the toothpaste will enter the duct and exit therefrom onto the bristles on said brush member.

* * * * *